US011445822B1

(12) United States Patent
Werner

(10) Patent No.: US 11,445,822 B1
(45) Date of Patent: Sep. 20, 2022

(54) EXPANDABLE MODULAR RACK FOR STORING AT LEAST ONE MAGAZINE AND AT LEAST ONE HANDGUN

(71) Applicant: United States Marketing Corp., Middleburgh, NY (US)

(72) Inventor: Theodore J. Werner, Middleburgh, NY (US)

(73) Assignee: UNITED STATES MARKETING CORP., Middleburgh, NY (US)

( * ) Notice: Subject to any disclaimer, the term of this patent is extended or adjusted under 35 U.S.C. 154(b) by 0 days.

(21) Appl. No.: 17/242,674

(22) Filed: Apr. 28, 2021

(51) Int. Cl.
*A47B 81/00* (2006.01)
*A47B 47/00* (2006.01)

(52) U.S. Cl.
CPC ..... *A47B 81/005* (2013.01); *A47B 47/0091* (2013.01)

(58) Field of Classification Search
CPC ... A47B 81/00; A47B 81/005; A47B 47/0091; A47B 47/047; A47B 65/15; F41A 23/18; F41C 33/06
USPC ..... 211/64
See application file for complete search history.

(56) References Cited

U.S. PATENT DOCUMENTS

| | | | | |
|---|---|---|---|---|
| 856,316 | A | 6/1907 | Thurston | |
| 945,877 | A | 1/1910 | Updegraff | |
| 1,597,565 | A | 8/1926 | Backus | |
| 2,511,735 | A | 6/1950 | Patterson | |
| 2,620,929 | A | 12/1952 | Sportsman | |
| 2,740,530 | A | 4/1956 | Ponder | |
| 2,959,293 | A | 11/1960 | Meyer | |
| 3,031,069 | A | 4/1962 | Hirsch | |
| 3,329,278 | A | 7/1967 | Pachmayr | |
| 3,356,229 | A * | 12/1967 | Rhymes, Jr. | A24F 9/14 211/70.3 |
| 3,731,818 | A | 5/1973 | Young | |

(Continued)

FOREIGN PATENT DOCUMENTS

CA 2089432 A1 * 8/1994 ..... F41C 33/06

OTHER PUBLICATIONS

Metesh, T. Logan, "SHOT Show 2019: Best New Gun and Ammo Storage Solutions", https://www.range365.com/shot-show-2019-best-new-gun-and-ammo-storage-solutions/, Jan. 31, 2019.

(Continued)

*Primary Examiner* — Stanton L Krycinski
(74) *Attorney, Agent, or Firm* — Madeline F. Schiesser; Keohane & D'Alessandro, PLLC

(57) ABSTRACT

An expandable modular rack for storing at least one magazine and at least one handgun is disclosed. The expandable modular rack includes: a first member; a second member having a base and at least one protrusion extending from a medial portion of the base; and a means for joining a surface of the first member to a surface of the second member, wherein the first member is arranged to maintain the magazine in an upright position, and wherein the base of the second member is arranged to support a base of the magazine and the protrusion of the second member is arrangeable to maintain the magazine in the upright position. The rack can further include: a third member; and a means for joining the first member to the third member, wherein the third member and first member are arranged to support the handgun.

17 Claims, 12 Drawing Sheets

(56) References Cited

U.S. PATENT DOCUMENTS

| | | | | |
|---|---|---|---|---|
| 4,537,315 | A | 8/1985 | Griffin | |
| 4,890,466 | A | 1/1990 | Cislo | |
| 4,970,006 | A * | 11/1990 | Martinez | A47G 21/14 248/37.3 |
| 4,971,208 | A | 11/1990 | Reinfried et al. | |
| 5,143,227 | A * | 9/1992 | Schubert | A47B 81/005 206/317 |
| 5,193,680 | A * | 3/1993 | Schumann | B65H 16/021 206/394 |
| 5,228,578 | A | 7/1993 | Wu | |
| 5,375,337 | A | 12/1994 | Butler | |
| 5,503,276 | A | 4/1996 | Pierce | |
| 5,520,291 | A | 5/1996 | Graham | |
| 5,520,294 | A | 5/1996 | Hanes | |
| 5,720,193 | A * | 2/1998 | Dick | E05B 37/00 211/64 |
| 5,850,784 | A * | 12/1998 | Conner | A47G 21/14 99/485 |
| 5,996,865 | A | 12/1999 | Bissey | |
| 6,547,070 | B1 | 4/2003 | Kolpin | |
| D500,638 | S * | 1/2005 | Srivastava | D7/601 |
| 7,448,506 | B2 * | 11/2008 | Berti | A47G 21/14 206/553 |
| D587,051 | S * | 2/2009 | Vining | D6/552 |
| 7,584,861 | B2 * | 9/2009 | Werner | A47B 45/00 211/184 |
| D632,901 | S * | 2/2011 | Christoffel | D6/683 |
| 7,934,610 | B2 * | 5/2011 | Zeng | A47G 21/14 211/70.7 |
| 8,955,697 | B2 | 2/2015 | Spiloro | |
| 9,345,323 | B1 * | 5/2016 | Kubiniec | A47B 96/027 |
| 9,383,179 | B1 | 7/2016 | Spilotro | |
| 9,523,545 | B1 * | 12/2016 | Weller | F41C 33/0281 |
| 10,151,559 | B2 * | 12/2018 | Higgins | A47C 21/00 |
| 10,234,235 | B2 * | 3/2019 | Higgins | F41C 33/0227 |
| 10,563,946 | B2 * | 2/2020 | Couie | F41A 23/18 |
| 10,697,727 | B2 * | 6/2020 | Higgins | F41A 23/18 |
| 11,064,841 | B2 * | 7/2021 | Nathan | A47B 81/04 |
| 2005/0230334 | A1 * | 10/2005 | MacDonald | A47B 81/005 211/64 |
| 2008/0060205 | A1 * | 3/2008 | Schmidt | A47G 21/14 30/298.4 |
| 2012/0261368 | A1 * | 10/2012 | Klein | A47F 7/0028 211/64 |
| 2014/0069880 | A1 | 3/2014 | Spilotro | |
| 2014/0183148 | A1 * | 7/2014 | Ho | A47J 47/16 211/49.1 |
| 2016/0153745 | A1 | 6/2016 | Higgins | |
| 2018/0178336 | A1 * | 6/2018 | Gussmann | B23Q 7/10 |
| 2019/0072356 | A1 | 3/2019 | Couie | |

OTHER PUBLICATIONS

AMAZON.com, "Mag Storage Solutions, Pistol Magazine Holder—Organize Your Pistol Magazines & Ammo", https://www.amazon.com/Storage-Solutions-Pistol-Magazine-Holder/dp/B01780C1KW, Apr. 2, 2021, 7 pgs.

* cited by examiner

EXPANDABLE MODULAR RACK FOR STORING AT LEAST ONE MAGAZINE AND AT LEAST ONE HANDGUN

TECHNICAL FIELD

The present invention relates generally to a rack for handgun magazines and handguns, and more particularly, the present invention relates to an expandable modular rack for storing at least one handgun magazine and at least one handgun of any width and/or at least similarly configured items in their normal upright position or an inverted position.

BACKGROUND

Sportsmen who collect or use firearms, as a general rule, take particularly good care of the weapons they own including the cleaning and storage aspects of responsible ownership. With regard to handguns, most owners keep their small guns and associated accessories locked in a secure location, and often owners will have a commercial safe in their home for the sole purpose of securing their handguns.

Many individuals and organizations usually maintain and store firearms and accessories (e.g., magazines, ammunition) in some form of locking device to provide a certain amount of security for the weapon or weapons. These security requirements are to prevent unauthorized use or theft of the weapon or weapons. In particular, an unsecured weapon in a home leaves the home vulnerable to robbery and subsequent theft of any weapons, or the weapon could be used on the homeowner by the robber. While sometimes an owner will store firearms in a locking rack, such is generally made of wood and offers very little security for the contained weapon. Moreover, most gun racks are loosely attached to a wall or similar object, which means that the entire gun rack may be taken for later removal of the contained firearms.

One of the inconveniences of storing handguns is that it is convention to store a handgun by laying it on its side. In some situations, the gun is in the original case it was in when purchased, in other situations the gun is simply laid on a towel or blanket. Some magazines can be stored upright, but may easily be knocked over like dominos, making laying the magazines down a safer option. Unfortunately, space in an affordable safe is generally limited and therefore storing handguns and spare magazines quickly uses the available space, leaving the active owner in a state of consternation.

Numerous innovations for handgun storing devices have been provided in the prior art that will be described below. Even though these innovations may be suitable for the specific individual purposes to which they address, they each differ in structure and/or operation and/or purpose from the present invention in that they do not teach an expandable modular rack for storing at least one magazine and at least one handgun of any width and/or at least similarly configured items (i.e., items having about the same shape and dimensions as a magazine and handgun) in their normal upright position or an inverted position.

U.S. Pat. No. 4,890,466 issued to Cislo on Jan. 2, 1990 teaches an apparatus to lock a handgun within a compartment while the compartment is readily lockable to a stationary object using a detachable bracket. The compartment is only accessible by authorized persons selecting a particular code that unlocks a latch to open the compartment. The bracket can only be detached when the apparatus is in an open position. The latch can be lighted to allow the selecting of the proper code in darkness. The apparatus also serves to carry the handgun and can be subsequently used to so secure the handgun at another location.

U.S. Pat. No. 5,503,276 issued to Pierce on Apr. 2, 1996 teaches a stand for storing multiple handguns, including a base and a vertical panel perpendicular to the base. The vertical panel contains a number of slots with a follower behind the panel and studs extending through the panel to engage a threaded cavity in the follower. The stud and follower slide in the slot and are locked in place by a stop ring on the stud. The barrel of a handgun slides over the stud and the heel of the grip may rest on the base.

U.S. Pat. No. 5,520,291 issued to Graham on May 28, 1996 teaches a manner of locking firearms within a theft proof gun rack. The apparatus comes in two embodiments for use with long guns or pistols and utilizes a locking bar locking the firearm within a given partition within the gun rack. The long gun embodiment of the apparatus accepts various sized guns, either in or out of soft gun cases, by using an optional spacer to accept smaller guns within the rack. The apparatus is designed to be mounted to a wall or similar object, and once a firearm is in place and locked, the mounting bolts are unreachable. Protection of the finish of the firearm is afforded by a resilient covering on all parts of the rack that come in contact with the firearm.

U.S. Pat. No. 5,996,865 issued to Bissey on Dec. 7, 1999 teaches a container for securing a hand gun and ammunition in the passenger compartment of a vehicle. The container is foam lined and has preformed contour receptacles for accommodating a particular style of hand gun and ammunition associated therewith. The container has a securable lid and a hinged flap along a lower edge for insertion between the passenger seat and the passenger seat back rest. The hinged flap has a securing apparatus for attachment once so inserted. The container further has hook and loop fasteners secured to the underside for alternatively securing the container to the front passenger floor of the passenger compartment.

U.S. Pat. No. 6,547,070 issued to Kolpin on Apr. 15, 2003 teaches a handgun case for protecting and transporting a pistol or revolver, including a closable outer shell, an inner liner within the outer shell, a variety of accessories removably attachable to the inner liner at any point on the inner liner, for example by hook-and-loop fasteners, a closed-cell foam pad between the outer shell and the inner liner, and a number of resilient protective ribs on the outer shell.

It is apparent that numerous innovations for handgun storing devices have been provided in the prior art that are adapted to be used. Furthermore, even though these innovations may be suitable for the specific individual purposes to which they address, they would not be suitable for the purposes of the present invention as heretofore described, namely, an expandable modular rack for storing at least one magazine and at least one handgun of any width and/or at least similarly configured items in their normal upright position or an inverted position.

SUMMARY

Thus, an object of embodiments of the present invention is to provide an expandable modular rack for storing at least one magazine and at least one handgun of any width and/or at least similarly configured items in their normal upright position or an inverted position that avoids the disadvantages of the prior art.

Briefly stated, another object of embodiments of the present invention is to provide an expandable modular rack for storing at least one magazine and at least one handgun of any width and/or at least similarly configured items. The expandable modular rack includes: a first member; a second member having a base and at least one protrusion extending from a medial portion of the base; and a means for joining a surface of the first member to a surface of the second member, wherein the first member is arranged to maintain the magazine in an upright position, and wherein the base of the second member is arranged to support a base of the magazine and the protrusion of the second member is arrangeable to maintain the magazine in the upright position. The rack can further include: a third member; and a means for joining the first member to the third member, wherein the third member and first member are arranged to support the handgun.

The novel features which are considered characteristic of embodiments of the present invention are set forth in the appended claims. The invention itself, however, both as to its construction and its method of operation together with additional objects and advantages thereof will be best understood from the following description of the specific embodiments when read and understood in connection with the accompanying drawing.

BRIEF DESCRIPTION OF THE SEVERAL VIEWS OF THE DRAWINGS

These and other features of this invention will be more readily understood from the following detailed description of the various aspects of the invention taken in conjunction with the accompanying drawings, as follows.

FIG. 1 includes the following elements:

- 2 at least one box magazine of any width and/or at least one similarly configured item;
- 4 base of a at least one box magazine 2 of any width and/or at least one similarly configured item;
- 6 body of a at least one box magazine 2 of any width and/or at least one similarly configured item;
- 10 expandable modular rack according to an embodiment of the present invention for storing at least one magazine 2 and at least one handgun 12 of any width and/or at least similarly configured items in their normal upright positions or inverted positions;
- 12 at least one handgun of any width and/or at least one similarly configured item;
- 14 barrel of a handgun of at least one handgun 12 of any width and/or each similarly configured item;
- 16 grip of a handgun of at least one handgun 12 of any width and/or each similarly configured item; and
- 18 heel of grip 16 of a handgun of at least one handgun 12 of any width and/or each similarly configured item.

Figure 1:
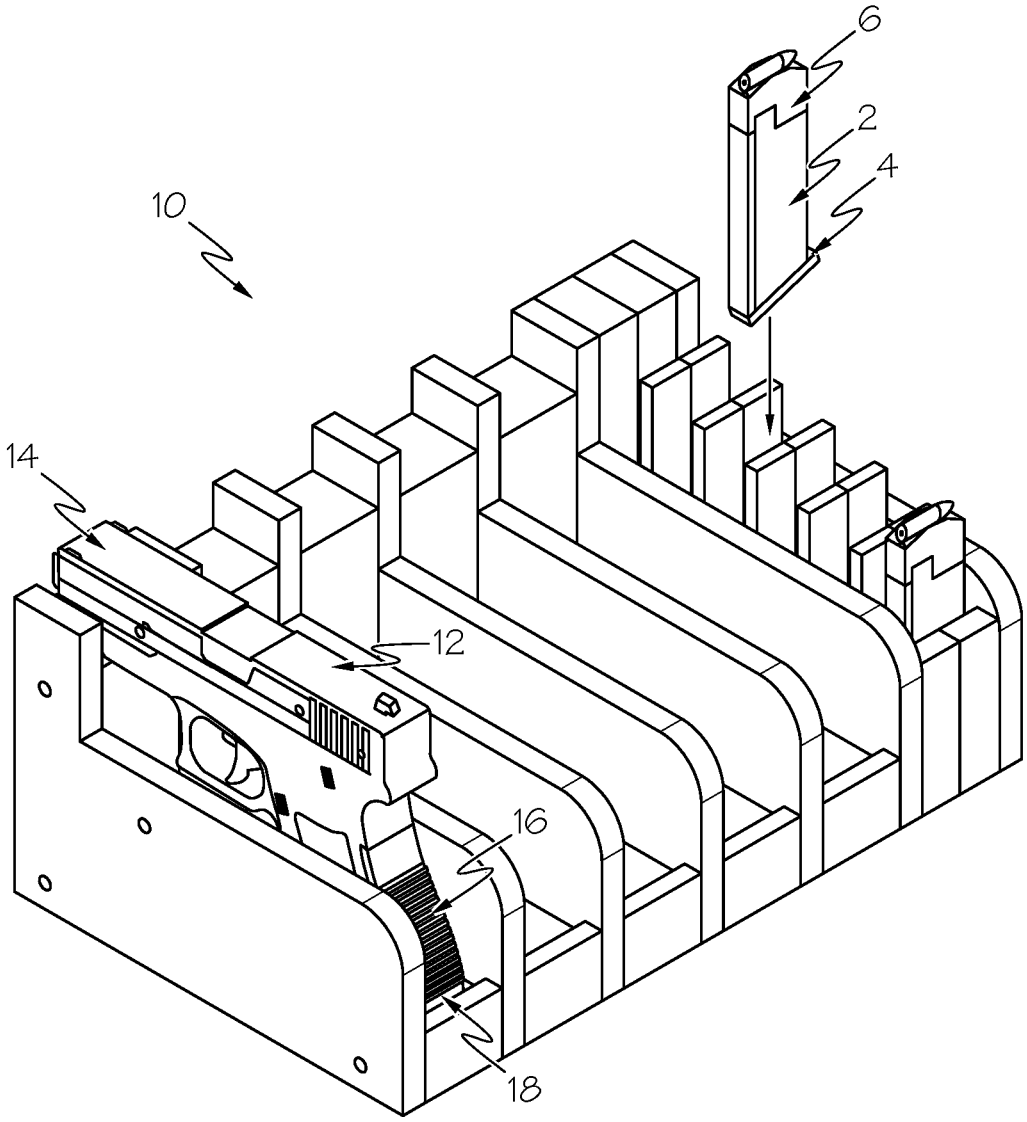
FIG. 1 is a diagrammatic perspective view of the expandable modular rack of an embodiment of the present invention storing at least one magazine and at least one handgun of any width and/or at least similarly configured items in their normal upright positions or inverted positions.
Figure 2:
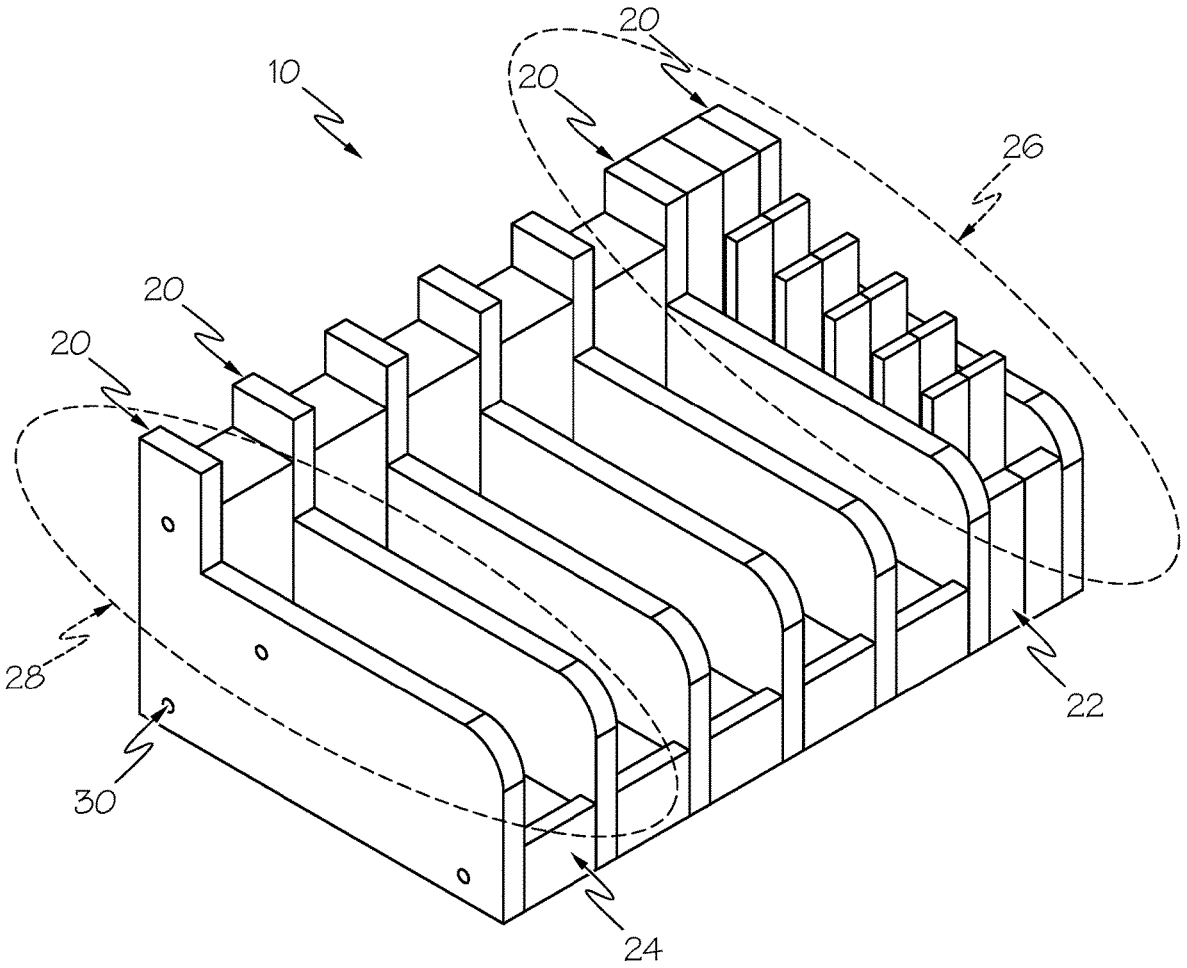

FIG. 2 is a diagrammatic perspective view of the expandable modular rack from FIG. 1 according to an embodiment of the present invention. FIG. 2 further includes the following elements:

- 20 at least one pair of first members;
- 22 at least one second member;
- 24 at least one third member;
- 26 at least one row of magazine bays;
- 28 at least one handgun bay; and
- 30 at least one set of member joiner means.

Figure 3A:
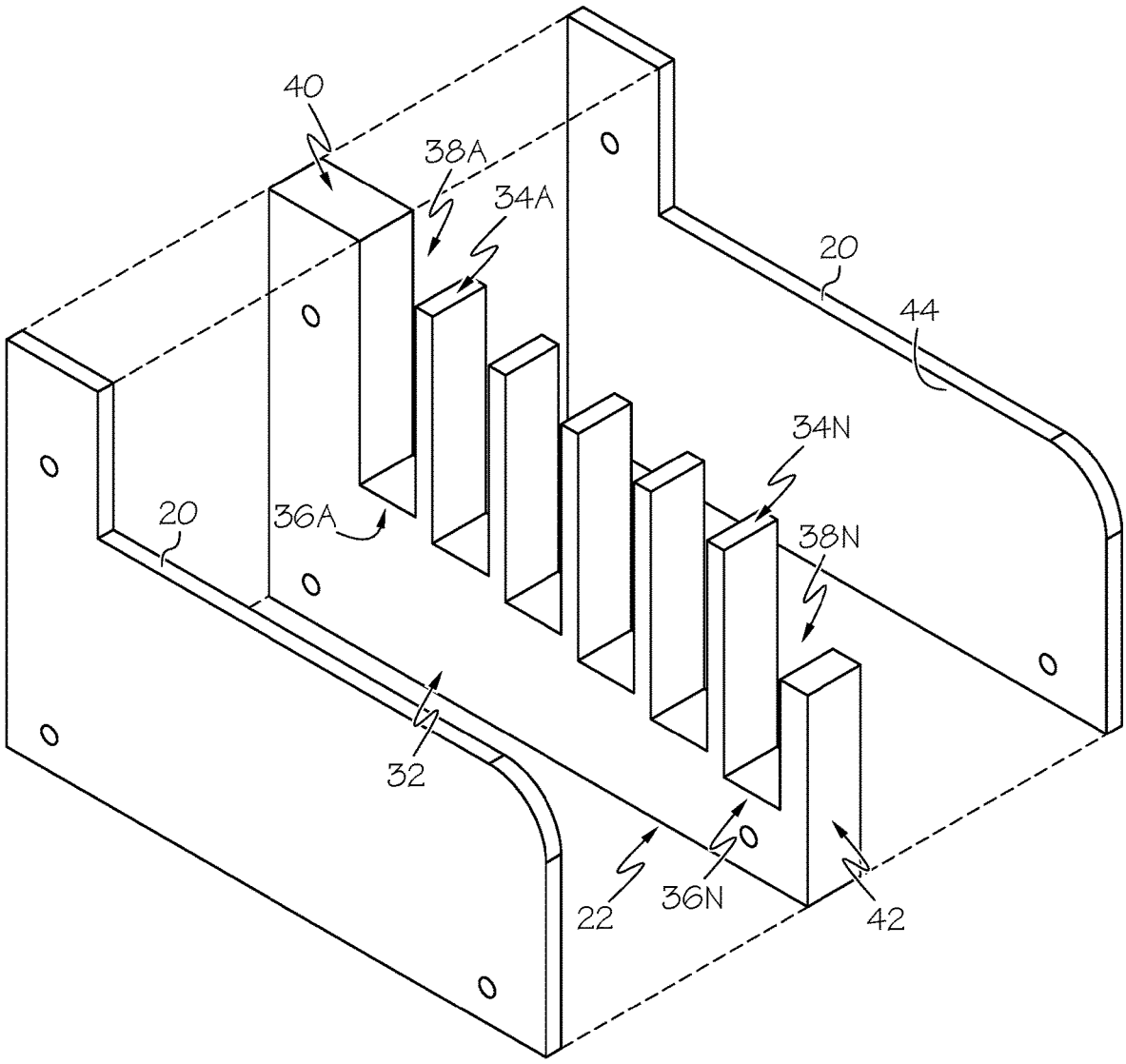
Figure 3B:
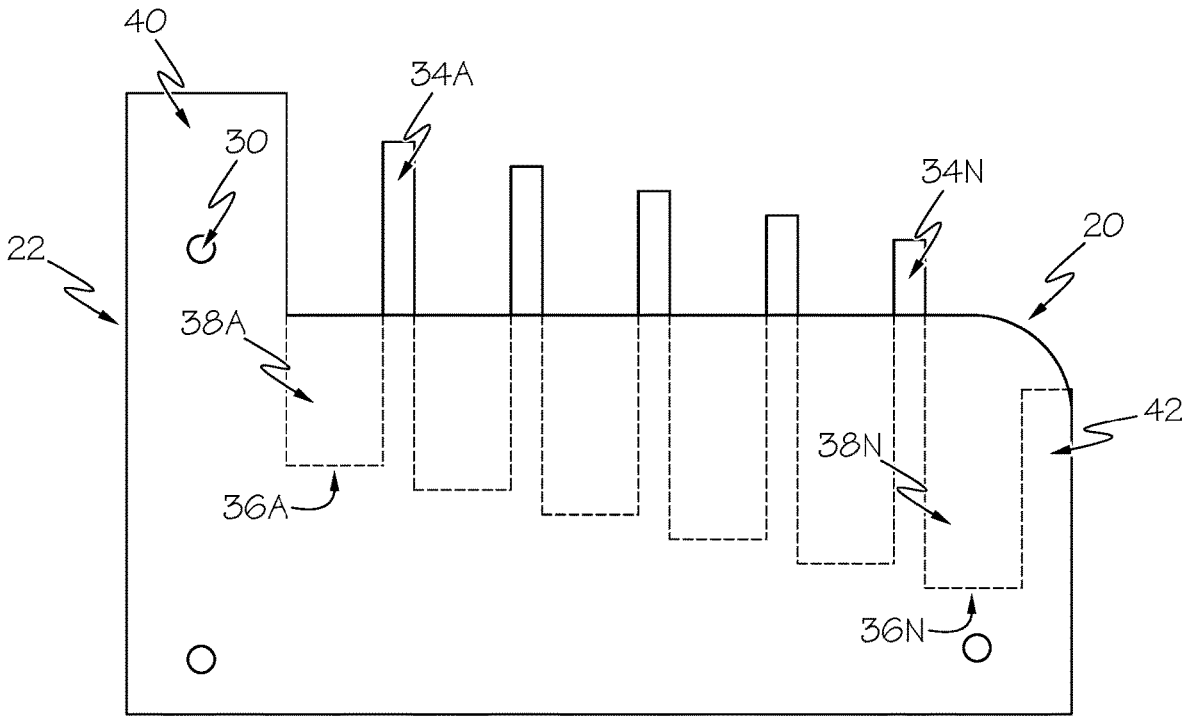

FIG. 3A is an exploded diagrammatic perspective view of a row of magazine bays 26 formed by a pair of first members 20 and at least one second member 22 according to an embodiment of the present invention. FIG. 3B is a side view of second member 22 according to an embodiment of the present invention fitted next to a first member 20. FIG. 3A and FIG. 3B further include the following elements:

- 32 a base portion of second member 22;
- 34A-N one or more protrusions extending from a medial portion base 32;
- 36A-N two or more magazine 2 base supporting areas;
- 38A-N magazine bays;
- 40 back protrusion;
- 42 front protrusion; and
- 44 inner side wall of first member 20.

FIGS. 4A, 4B, 4C, 4D, 4E, and 4F show example embodiments of the second member within the scope of the present invention. These Figures further include the following elements:

- 22A a first variation of second member 22;
- 46A-N magazine base supporting areas at tiered heights from one another;
- 48A-N medial protrusions having tiered heights relative to one another;
- 22B a second variation of second member 22;
- 50A-N magazine base supporting areas at a same height relative to one another;
- 52A-N medial protrusions having a same height relative to one another;
- 22C a third variation of second member 22;
- 54A-N medial protrusions having a height significantly shorter than that of magazine 2 they are intended to house;
- 22D a fourth variation of second member 22;
- 56A-N medial protrusions at an acute angle relative to a horizontal plane;
- 22E a fifth variation of second member 22;
- 58 a front and/or back protrusion having the same proportions as a medial protrusion 34N;
- 22F a sixth variation of second member 22; and
- 60 an area from which back protrusion 40 has been removed.

Figure 5A:
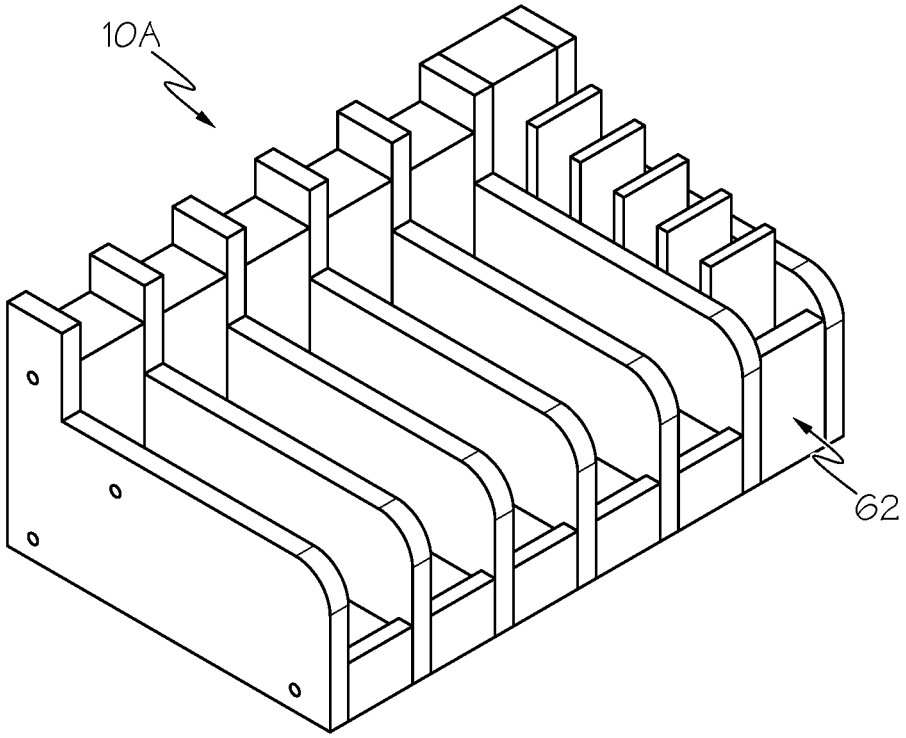
Figure 5B:
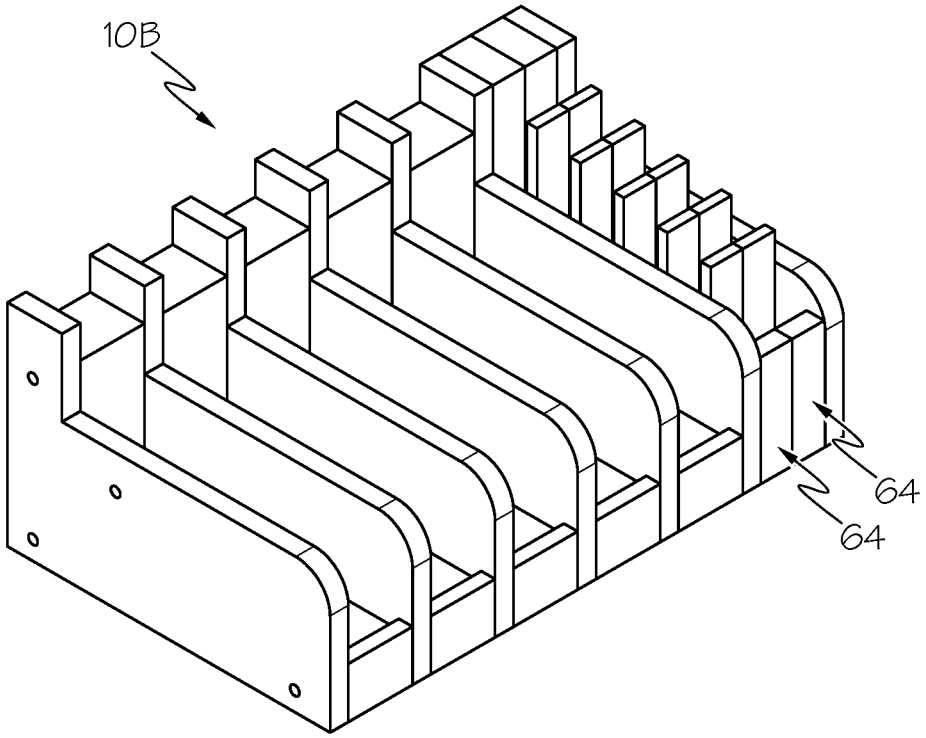
Figure 5C:
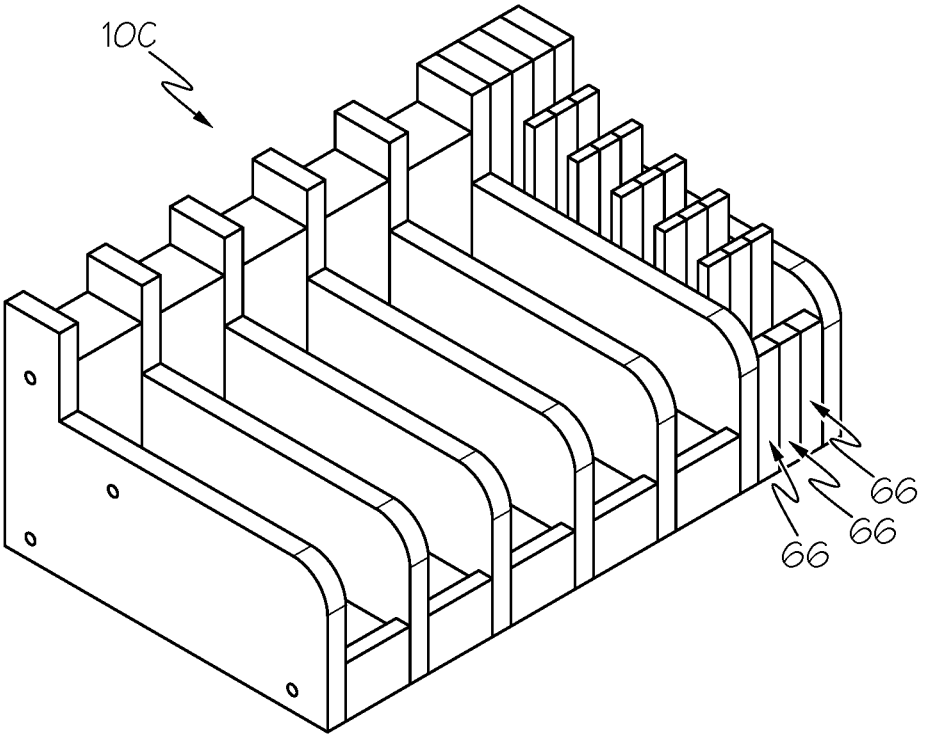

FIGS. 5A, 5B, and 5C show further examples of expandable modular racks 10 having second members 22 of various thicknesses. FIGS. 5A-C further include the following elements:

- 10A expandable modular rack having one second member 22 forming a row of magazine bays 26;
- 62 type of second member 22 having a thickness sufficient to accommodate magazine 2 without the need for successive members;
- 10B expandable modular rack having two second members 22 forming a row of magazine bays 26;
- 64 type of second member 22 having a thickness requiring multiple second members 22 to be place side-by-side to accommodate magazine 2;
- 10C expandable modular rack having three second members 22 forming a row of magazine bays 26; and
- 66 type of second member 22 having a thickness requiring multiple second members 22 to be place side-by-side to accommodate magazine 2.

Figure 6:
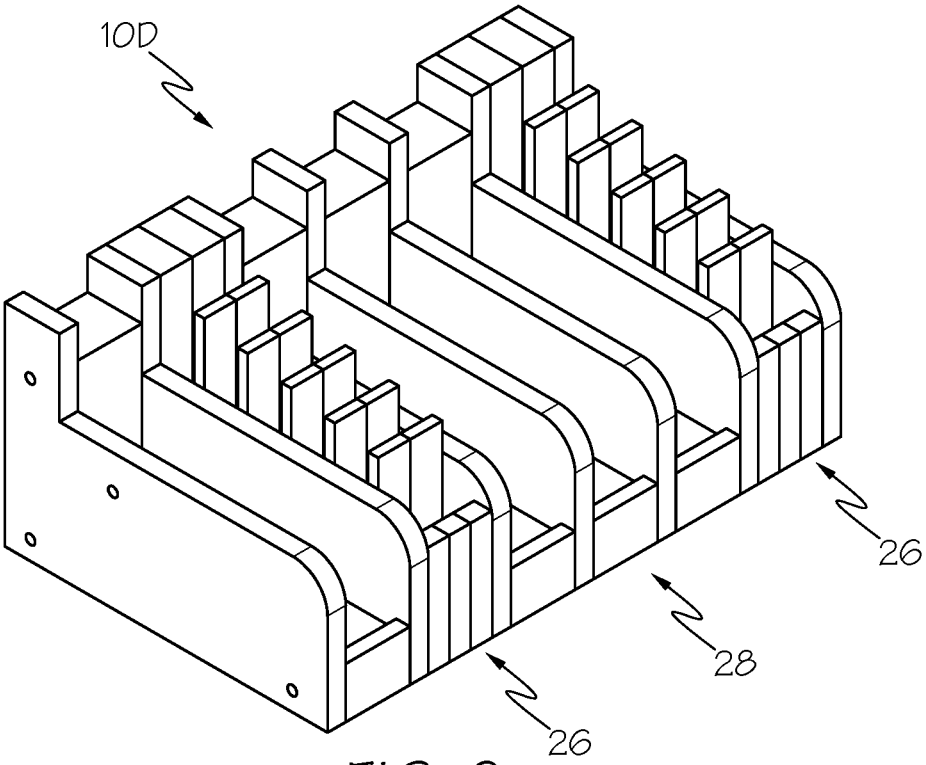

FIG. 6 shows an expandable module rack 10 having multiple rows of magazine bays 26 according to embodiments of the present invention.

Figure 7:
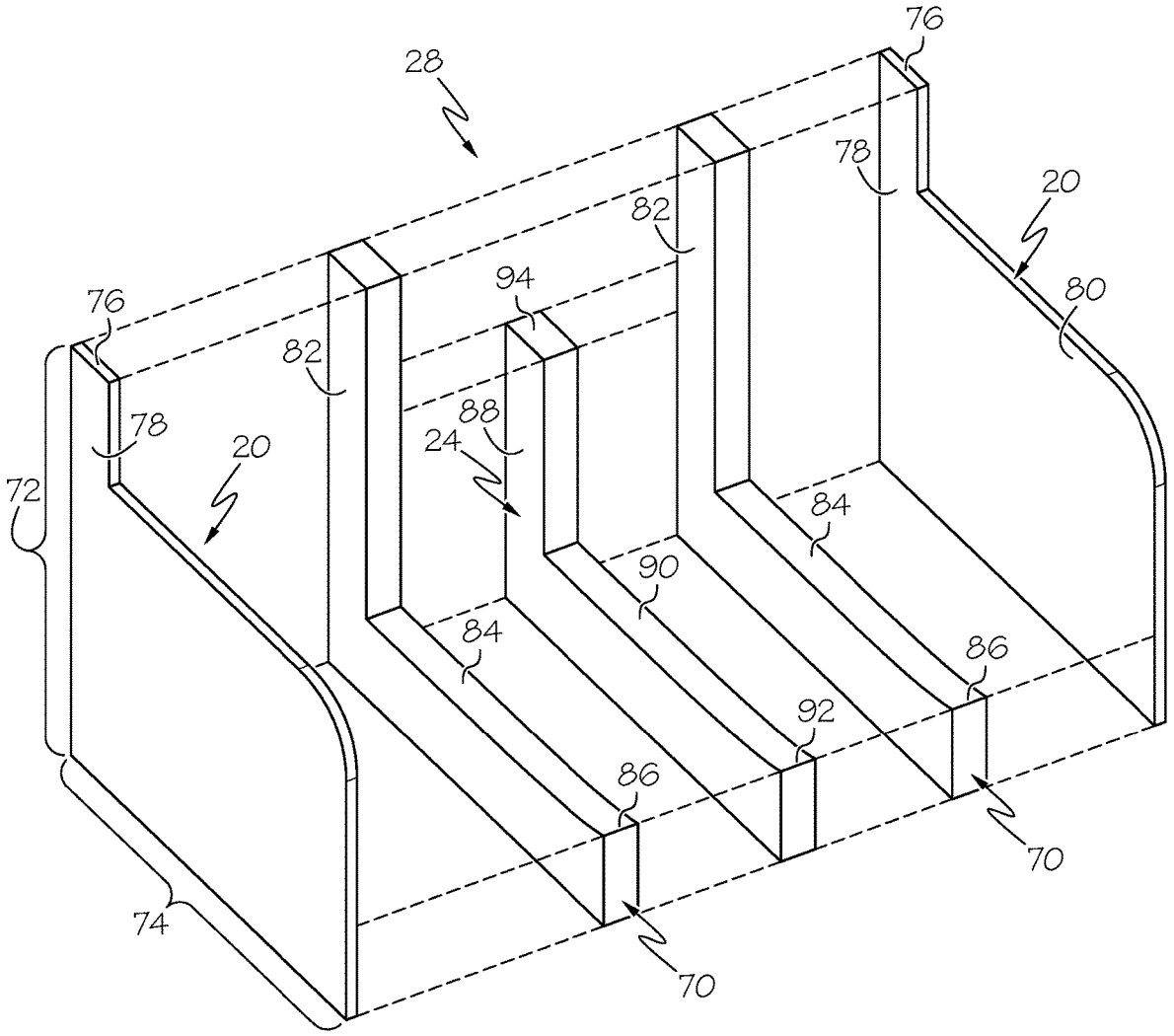

FIG. 7 is an exploded diagrammatic perspective view of a handgun bay 28 formed by a pair of first members 20 and at least one third member 24 according to an embodiment of the present invention. FIG. 7 includes the following elements:

70 at least one pair of fourth members;

72 vertical portion of each bay of at least one handgun bay 28 for supporting barrel 14 of associated handgun 12 or associated similarly configured item;

74 horizontal portion of each bay of at least one handgun bay 28 for supporting heel 18 of grip 16 of associated handgun 12 or associated similarly configured item;

76 pair of partitions of each pair of first members of at least one pair of first members 20;

78 vertical portion of each partition of pair of partitions 76 of each first member of at least one pair of first members 20;

80 horizontal portion of each partition of pair of partitions 76 of each first member of at least one pair of first members 20 for separating associated handgun 12 or associated similarly configured item from other handguns 12 or magazines 2;

82 vertical portion of each fourth member of at least one pair of fourth members 70 for straddling barrel 14 of associated handgun 12 or associated similarly configured item;

84 horizontal portion of each fourth member of at least one pair of fourth members 70 for supporting heel 18 of grip 16 of associated handgun 12 or associated similarly configured item;

86 stop of horizontal portion of each fourth member of at least one pair of fourth members 70 for preventing heel 18 of grip 16 of associated handgun 12 or associated similarly configured item from moving back off horizontal portion 84 of associated pair of fourth members of at least one pair of fourth members 70;

88 vertical portion of each third member of at least one third member 24 for supporting barrel 14 of associated handgun 12 or associated similarly configured item;

90 horizontal portion of each third member of at least one third member 24 for supporting heel 18 of grip 16 of associated handgun 12 or associated similarly configured item;

92 stop of horizontal portion 90 of each third member of at least one third member 24 for preventing heel 18 of grip 16 of associated handgun 12 or associated similarly configured item from moving back off horizontal portion 90 of associated third member of at least one third member 24; and

94 relief in vertical portion 72 of each bay of at least one 26 for receiving barrel 14 of associated handgun 12 or associated similarly configured item.

Figure 8A:
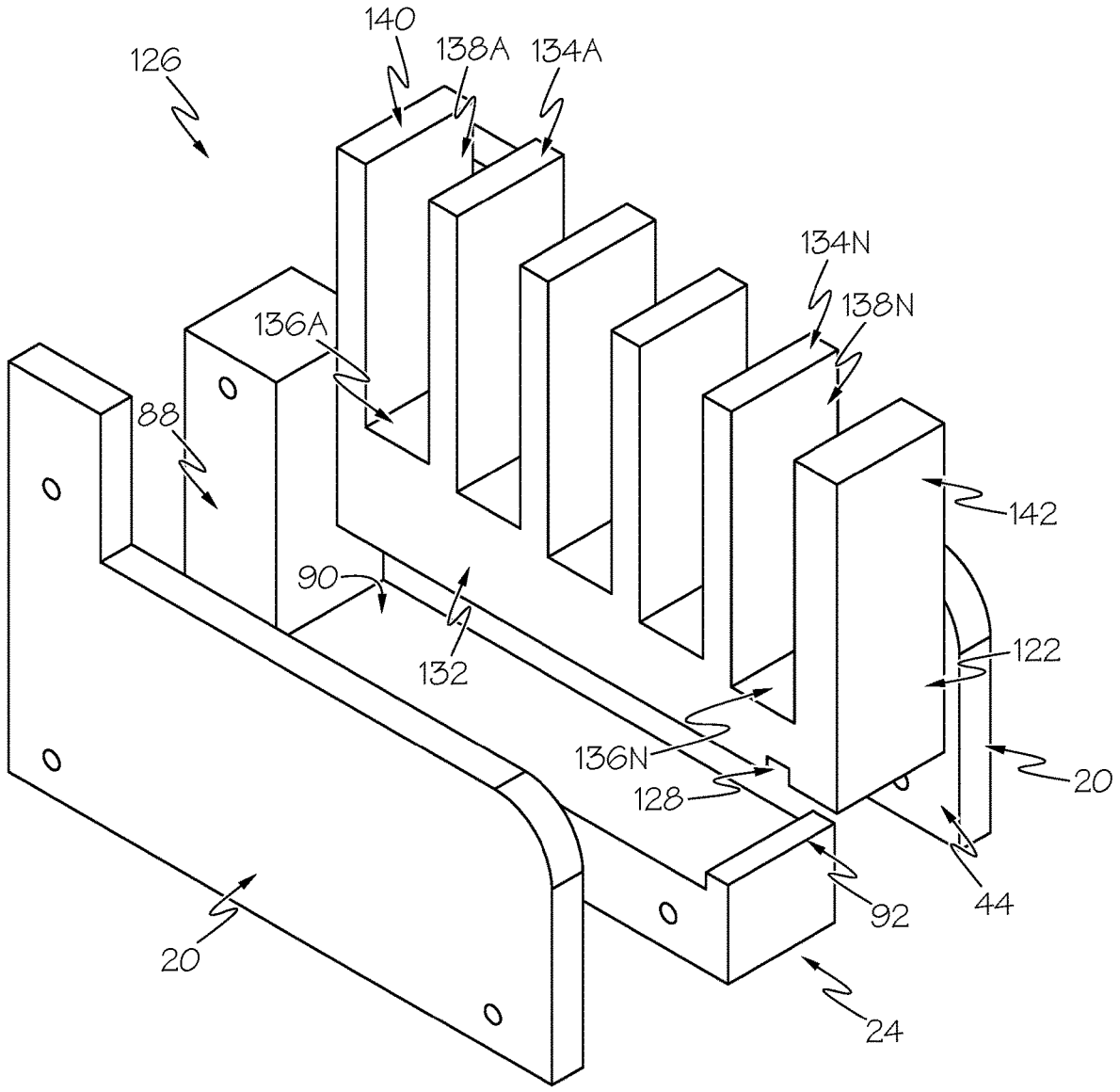
Figure 8B:
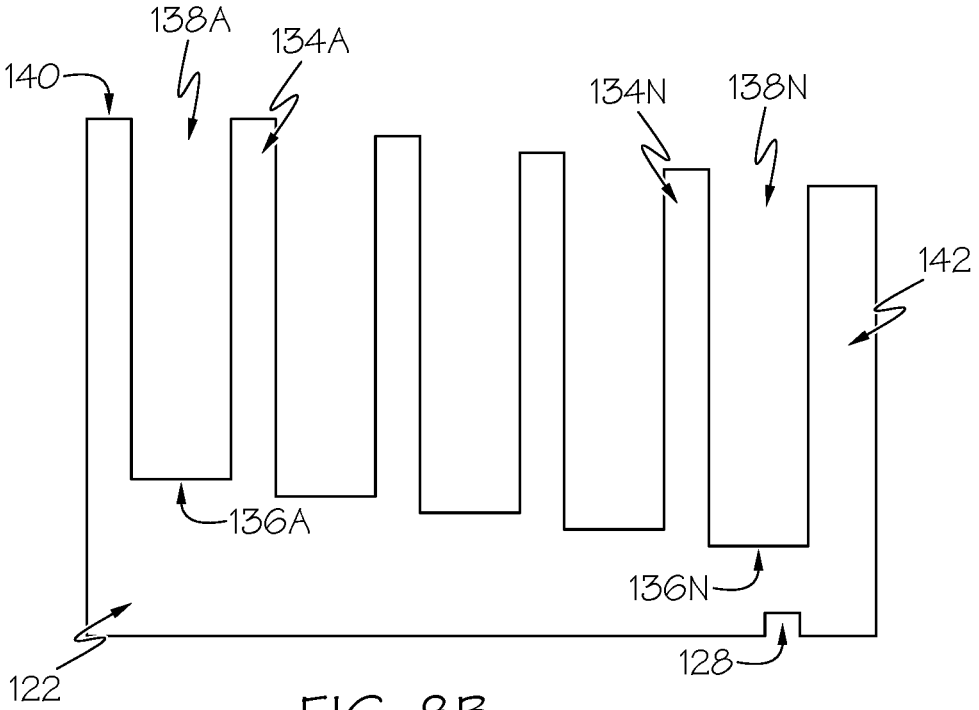
Figure 8C:
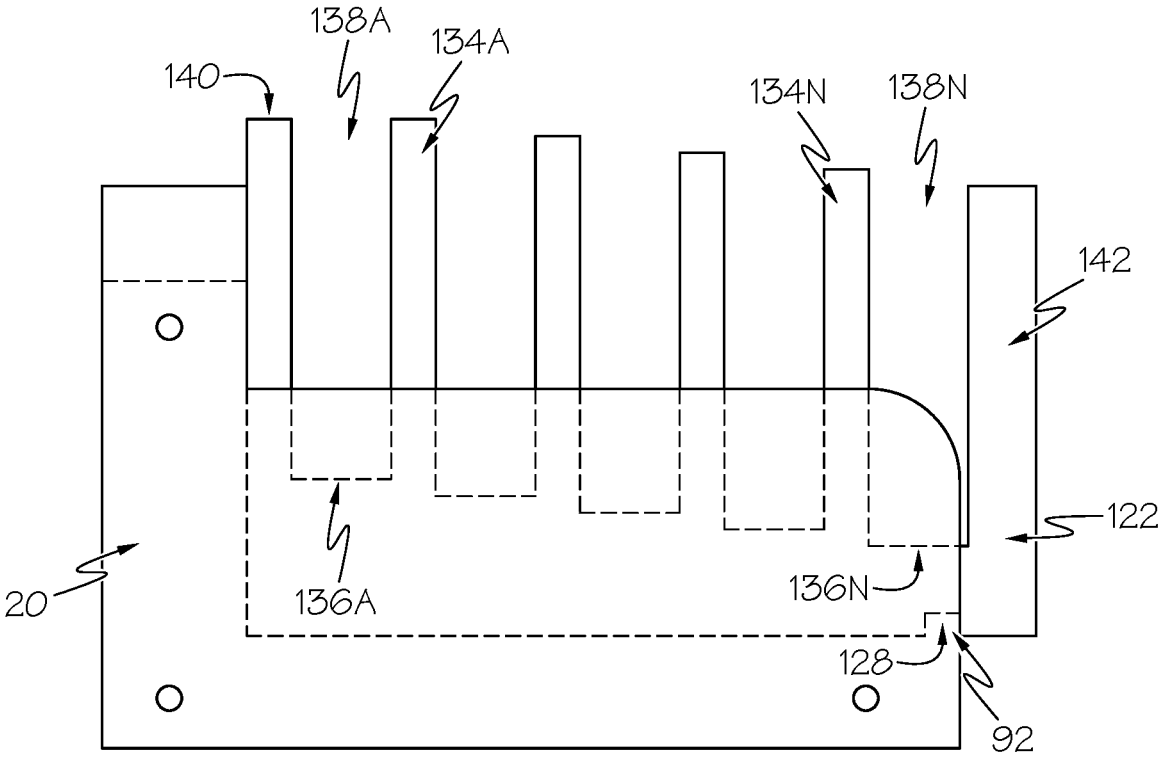

FIG. 8A is an exploded diagrammatic perspective view of an alternative embodiment of a row of magazine bays formed by a pair of first members 20, at least one third member 24, and a fourth member 122 according to an embodiment of the present invention. FIG. 8B shows an example embodiment of the fourth member 122 within the scope of the present invention. FIG. 8C is a side view of fourth member 122 according to an embodiment of the present invention fitted next to a first member 20. FIG. 8A, FIG. 8B, and FIG. 8C further include the following elements:

122 at least one fourth member;

126 alternative embodiment of a row of magazine bays;

128 attachment notch of fourth member 122; and

132 a base portion of fourth member 122.

134A-N one or more protrusions extending from a medial portion base 132;

136A-N two or more magazine 2 base supporting areas;

138A-N magazine bays;

140 back protrusion; and

142 front protrusion.

The drawings are not necessarily to scale. The drawings are merely representations, not intended to portray specific parameters of the invention. The drawings are intended to depict only typical embodiments of the invention, and therefore should not be considered as limiting in scope. In the drawings, like numbering represents like elements.

DETAILED DESCRIPTION

Illustrative embodiments will now be described more fully herein with reference to the accompanying drawings, in which illustrative embodiments are shown. It will be appreciated that this disclosure may be embodied in many different forms and should not be construed as limited to the illustrative embodiments set forth herein. Rather, these embodiments are provided so that this disclosure will be thorough and complete and will fully convey the scope of this disclosure to those skilled in the art.

Furthermore, the terminology used herein is for the purpose of describing particular embodiments only and is not intended to be limiting of this disclosure. As used herein, the singular forms "a", "an", and "the" are intended to include the plural forms as well, unless the context clearly indicates otherwise. Furthermore, the use of the terms "a", "an", etc., do not denote a limitation of quantity, but rather denote the presence of at least one of the referenced items. It will be further understood that the terms "comprises" and/or "comprising", or "includes" and/or "including", when used in this specification, specify the presence of stated features, regions, integers, steps, operations, elements, and/or components, but do not preclude the presence or addition of one or more other features, regions, integers, steps, operations, elements, components, and/or groups thereof.

Referring now to FIG. 1, a diagrammatic perspective view is shown of expandable modular rack 10 of an embodiment of the present invention storing at least one magazine 2 and at least one handgun 12 of any width and/or at least similarly configured items in their normal upright position or inverted position.

According to some embodiments, magazine 2 can be a box magazine of any width, such as for a semi-automatic pistol. In some other embodiments, magazine 2 can be any similarly configured item (i.e., an item having about the same length, width, and depth as a typical box magazine, e.g., a battery for a hand-held cordless drill). Magazine 2 can have a base 4 and a body 6 of any length and/or width suitable for a box magazine. In some embodiments, body 6 can form an acute or right angle with base 4.

According to some embodiments, handgun 12 can be any handgun, such as a semi-automatic pistol or a revolver. In some other embodiments, handgun 12 can be any similarly configured item (i.e., an item having about the same shape and dimensions as a handgun, e.g., a hand-held cordless drill). Handgun 12 can have a barrel 14 (i.e., a laterally projecting portion) and a grip 16 with a heel 18 (i.e., a base portion). In some embodiments, barrel 14 and grip 16 form an obtuse angle.

Embodiments of the present invention can be used, among other things, for the storage, organization, and indexing of handguns and magazines. For example, an owner of several handguns can use one or more expandable modular racks 10 to sort his/her handguns by various features, such as caliber (e.g., .22, 9 mm, .40), type (e.g., semi-automatic pistol, revolver), and make (e.g., Smith and Wesson, Colt's). He/she can place handguns of a particular make and caliber together with associated magazines of said make having ammunition of said caliber. This makes finding a particular handgun and matching magazine far easier in a gun safe.

Referring now to FIG. 2 in addition to FIG. 1, a diagrammatic perspective view of expandable modular rack 10 from FIG. 1 is shown according to an embodiment of the present invention. According to an embodiment of the present invention, expandable modular rack 10 can comprise at least one pair of first members 20, at least one second member 22, and at least one third member 24. The at least one second member 22 and/or the at least one third member 24 can be sandwiched between the at least one pair of first members 20 to form at least one row of magazine bays 26 or at least one handgun bay 28, respectively. It is understood that a plurality of first members 20, second members 22, and third members 24 can be interchangeably attached to each other, side-by-side, so as to form as many magazine bay rows 26 and handgun bays 28 as desired. It is also to be understood that a plurality of second members 22 can be sandwiched between a pair of first members 20 to form a magazine bay row 26 of any desired width. Similarly, multiple third members 24 can be sandwiched between a pair of first members 20 to form a handgun bay 28 of any desired width.

According to embodiments of the present invention, members 20, 22, and 24 forming expandable modular rack 10 can be attached to one another, side-by-side, by any member joiner means 30 now known or later developed. Such member joiner means can include, but is not limited to elongated members (e.g., rods) and a plurality of end securing devices (e.g., clips), a threadable material (e.g., rope) with secured and/or knotted ends, hook and loop fabric, dual lock tape, ultrasonic bonding, a set of snaps, an adhesive substance, a synthetic setae material, a screw, a bolt, a nail, and a dowel.

For example, in once embodiment, members of expandable modular rack 10 are held together by a plurality of sturdy elongated members (e.g., rods) and a plurality of end securing devices (e.g., clips). The plurality of sturdy elongated members can extend laterally through a plurality of holes in each member of at least one row of magazine bays 26 and/or handgun bay 28 and originate and terminate in the plurality of end securing devices, respectively, so as to hold the at least one pair of first members 20, the at least one second member 22, and the at least one third member 24 interchangeably attached to each other, side-by-side. It is to be understood that in such an embodiment, each elongated member can be threadably telescopic or mechanically alterable through other means to be length adjustable to adjust to the full lateral length of any combination of first members 20, second members 22, and third members 24. Alternatively, each elongated member can be of a predetermined length (e.g., corresponding to the lateral length of a predetermined number of bays) and thereby requiring interchanging thereof to adjust for a particular number of the at least one pair of first members 20 and the at least one second member 22 and/or the at least one third member 24, and/or to adjust for a particular number of rows of magazine bays 26 or handgun bays 28, or any combination thereof.

In another embodiment, members of expandable modular rack 10 are held together by flexible, threadable material (e.g., a set of taut ropes) threaded laterally through a plurality of holes in each member of the at least one row of magazine bays 26 and/or handgun bay 28 and held in place by a plurality of clips, knots, or similar end structures. In this embodiment, it is understood that a length of threadable material and a plurality of members 20, 22, and 24 can be assembled into expandable modular rack 10, with the threadable material being cut and tied off at a desired length corresponding to a number of desired bays.

In still another embodiment, hook and loop fabric (better known under the tradename Velcro) can be adhered to at least a portion of the longitudinal face of members 20, 22, and 24, with hooks on a left side of each member and loops on a right side of each member, or vice versa, allowing a series of members 20, 22, and 24 to be removably attached to one another along their side-by-side faces. Alternatively, dual lock tape can be used in place of hook and loop fabric.

In yet another embodiment, each member 20, 22, and 24 can be made of a substance, such as plastic, and joined together along their side-by-side faces in a desired sequence using ultrasonic bonding (also known as sonic welding).

Similarly, in another embodiment, each member 20, 22, and 24 can have a set of female snaps on a left longitudinal face at specific positions and a set of male snaps on a right longitudinal face at corresponding specific positions, or vice versa, allowing a series of members 20, 22, and 24 to be removably attached to one another along their side-by-side faces where the male and female snaps join.

In still another embodiment, an adhesive substance, such as glue, may be applied to at least a portion of the longitudinal faces of members 20, 22, and/or 24, allowing a series of members 20, 22, and 24 to be permanently attached to one another along their side-by-side faces.

In yet another embodiment, a synthetic setae material, such as one using carbon nanotube technology, sometimes called nonotape, carbon nanotubes, "magic" tape, or "gecko" tape, may be applied to at least a portion of the longitudinal faces of members 20, 22, and/or 24, allowing a series of members 20, 22, and 24 to be removably attached to one another along their side-by-side faces.

In still yet another embodiment, a screw, a bolt, a nail, a dowel, or similar item can be driven laterally through a series of members 20, 22, and 24 configured into rows of magazine bays 26 and/or handgun bays 28, securing the members side-by-side.

According to some embodiments of the present invention, each of the at least one pair of first members 20, the at least one second member 22, and the at least one third member 24 can be made of a closed cell polymer, such as ethyl vinyl acetate, for preventing easy absorption of oil or grease from handgun 12 and/or magazine 2 and for preventing harming of the finish of handgun 12 and/or magazine 2. In some other embodiments of the present invention, members 20, 22, and 24 can be made of any material capable of supporting at least one handgun 12 and at least one magazine 6. For example, in some embodiments, members 20, 22, and 24 can be made of plastic, polymers, wood, metal, or composites thereof. Furthermore, each of members 20, 22, and 24 need not be made of the same material. For example, second member 22 and third member 24 could be made of a cushioning polymer, while first members 20 are made of stiffer wood or metal.

Referring now to FIG. 3A, an exploded diagrammatic perspective view is shown of a row of magazine bays 26 formed by a pair of first members 20 and at least one second member 22 according to an embodiment of the present invention.

Referring now also to FIG. 3B, a side view of second member 22 according to an embodiment of the present invention is also shown fitted next to a first member 20. According to some embodiments of the present invention, second member 22 includes at least a base portion 32 and at least one upright protrusion 34A extending from a medial or middle portion of base 32.

Some members 22 can have a plurality of upright protrusions 34A-N. The distance between successive upright protrusions 34A-N along a longitudinal axis of second member 22 is generally suitable for encompassing the width of a typical magazine 2. In some embodiments, this distance is about 10 to 30 mm. Each upright protrusion 34A-N can have a width along the longitudinal axis of second member 22 which, based on a strength and/or rigidity of the material from which expandable modular rack 10 is made, is suitable for supporting a typical magazine 2 in an upright position. In some embodiments, the width of an upright protrusion 34A-N along the longitudinal axis of second member 22 is about 1 to 20 mm.

According to some embodiments, distal ends of base 32 may also have back protrusion 40 and front protrusion 42, although such features need not appear in all embodiments of the present invention. Back protrusion 40 may be of a same height as the tallest portion of first member 20 and may have a width along the longitudinal axis of second member 22 equal to the width of the tallest portion of first member 20 along the longitudinal axis of first member 20. Front protrusion 42 may have a height equal to or lower than the shortest protrusion of upright protrusions 34A-N and a thickness at least as thick as that of an upright protrusion 34A-N.

Between upright protrusions 34A-N, along a top of base portion 32 of second member 22, are a plurality of magazine base supporting areas 36A-N. Base 4 of a magazine 2 may rest upon this area, while body 6 of the magazine 2 is supported in an upright or inverted position by inner side walls 44 of a pair of first members 20 and by a pair of upright protrusions 34A-N (or, in the case of the first or last supporting area 36A or 36N, by one upright protrusion 34A or N and back protrusion 40 or front protrusion 42, respectively). The inner side walls 44 of a pair of first members 20 and each pair of upright protrusions 34A-N form magazine bays 38A-N. As mentioned above the longitudinal distance between upright protrusions 34A-N is about 10 to 30 mm, making each magazine bay 38A-N about 10 to 30 mm wide along the longitudinal axis of second member 22. A magazine 2 may be deposited into each magazine bay 38A-N when expandable modular rack 10 is in use.

Referring now to FIGS. 4A-4E, several examples of various embodiments of second member 22 are shown. It is understood that second member 22 can be modified in both the manners shown herein as well as other manners which will occur to those trained in the art. Furthermore, second member 22 can be modified using any combination of the various modifications shown herein. All such modifications are to be considered within the scope of the present invention.

Figure 4A:
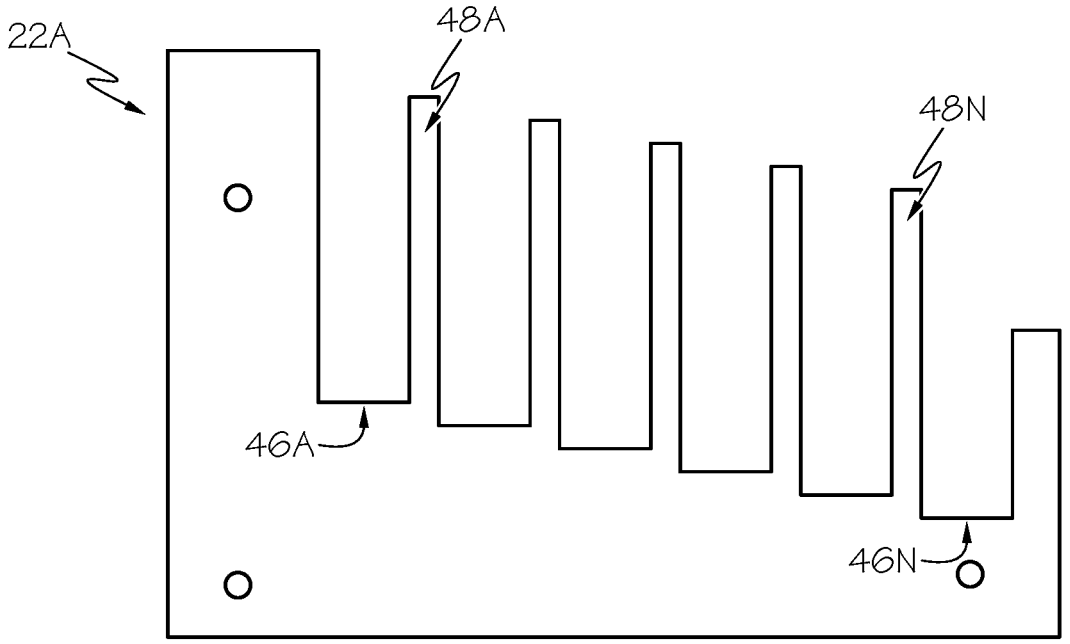

A first variation 22A of second member 22 is shown in FIG. 4A. In this variation, the second member has magazine base supporting areas 46A-N at tiered heights from one another, as well as medial protrusions 48A-N also at tiered heights relative to one another. In first variation 22A, medial protrusions 48A-N are between 30 and 150 mm tall relative to the magazine base supporting area 46A-N directly proceeding them.

Figure 4B:
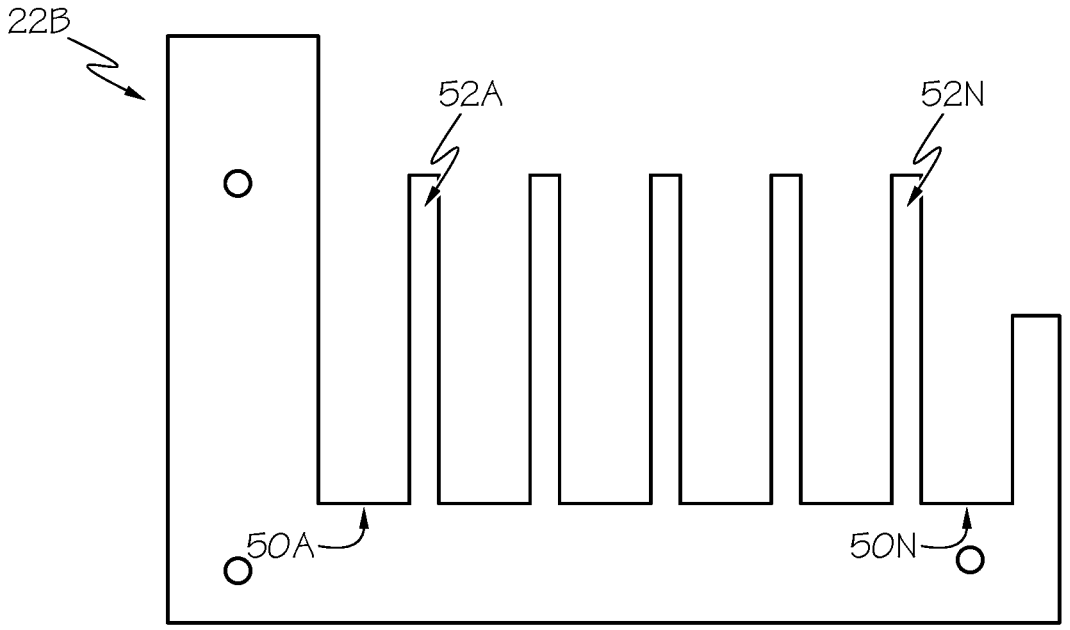

A second variation 22B of second member 22 is shown in FIG. 4B. In this variation, the second member has magazine base supporting areas 50A-N at a same height relative to one another, as well as medial protrusions 52A-N also at a same height relative to one another. In second variation 22B, medial protrusions 52A-N are between 30 and 150 mm tall relative to the magazine base supporting areas 50A-N.

Figure 4C:
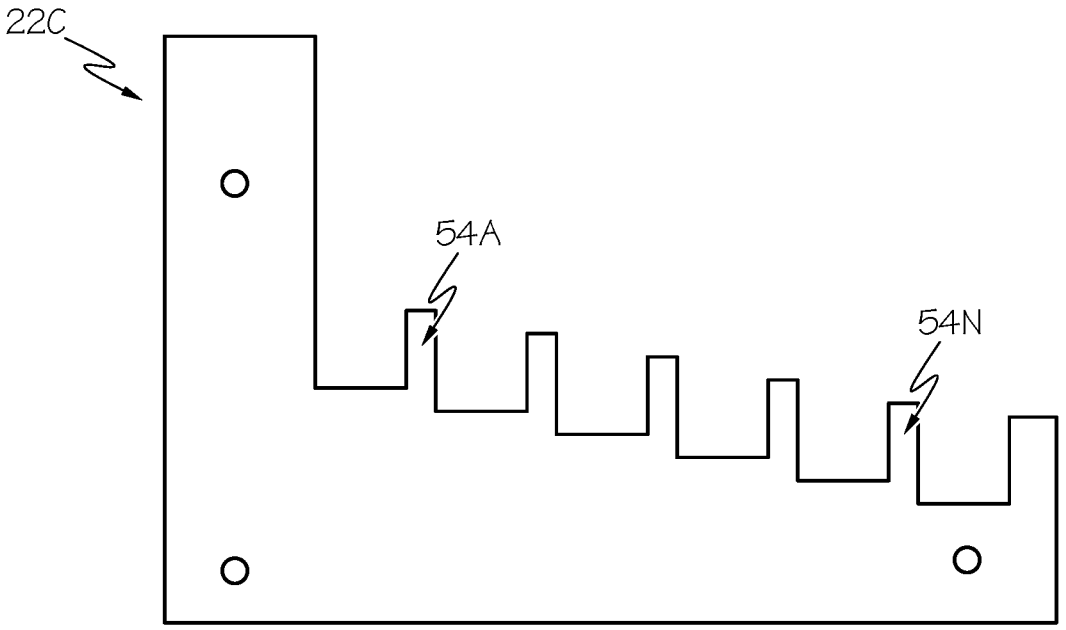

A third variation 22C of second member 22 is shown in FIG. 4C. In this variation, the second member has medial protrusions 54A-N having a height significantly shorter than that of magazine 2 they are intended to house between themselves. In third variation 22C, medial protrusions 54A-N define "depressions" in which base 4 of magazine 2 are to sit. In this variation 22C, medial protrusions 54A-N are between 0 and 30 mm tall relative to the magazine base supporting area 46A-N directly proceeding them. It should be noted that, in some embodiments, second member 22 does not have medial protrusions 34A-N and, instead, is merely a tiered series of magazine base supporting areas 36A-N.

Figure 4D:
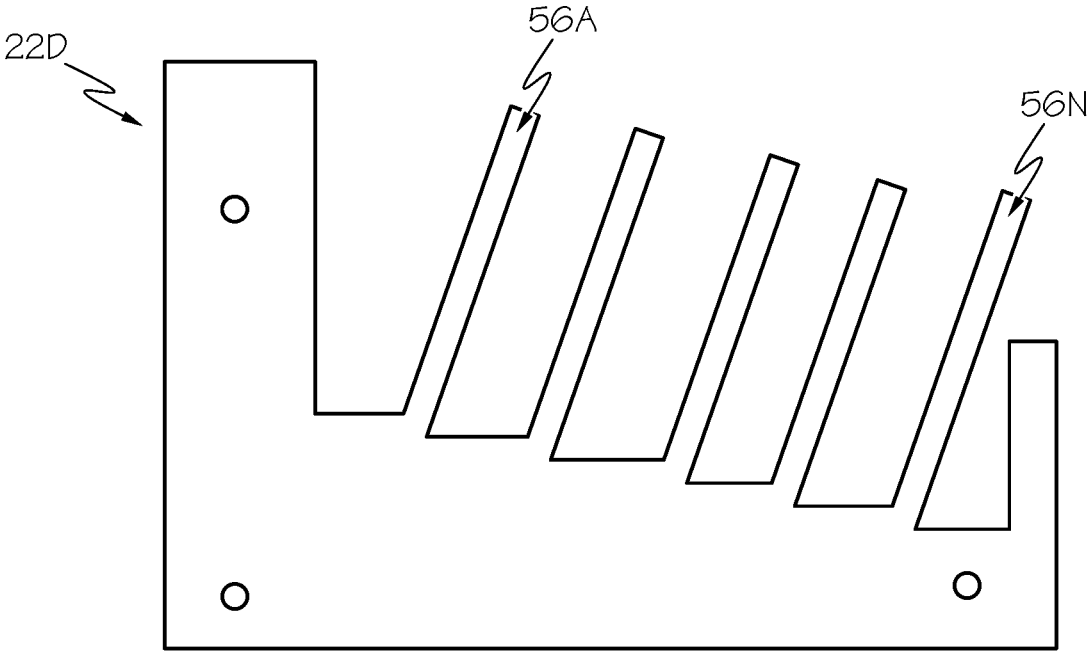

A fourth variation 22D of second member 22 is shown in FIG. 4D. In this variation, the second member has medial protrusions 56A-N having an acute angle relative to a horizontal plane. As some types of box magazines 2 have a body 6 that forms an acute angle with base 4 of magazine 2, the angle of medial protrusions 56A-N can be customized to accommodate a box magazine 2 slanted at a particular angle. In this variation, the angle of medial protrusions 56A-N is between 30 and 90 degrees relative to a horizontal plane.

Figure 4E:
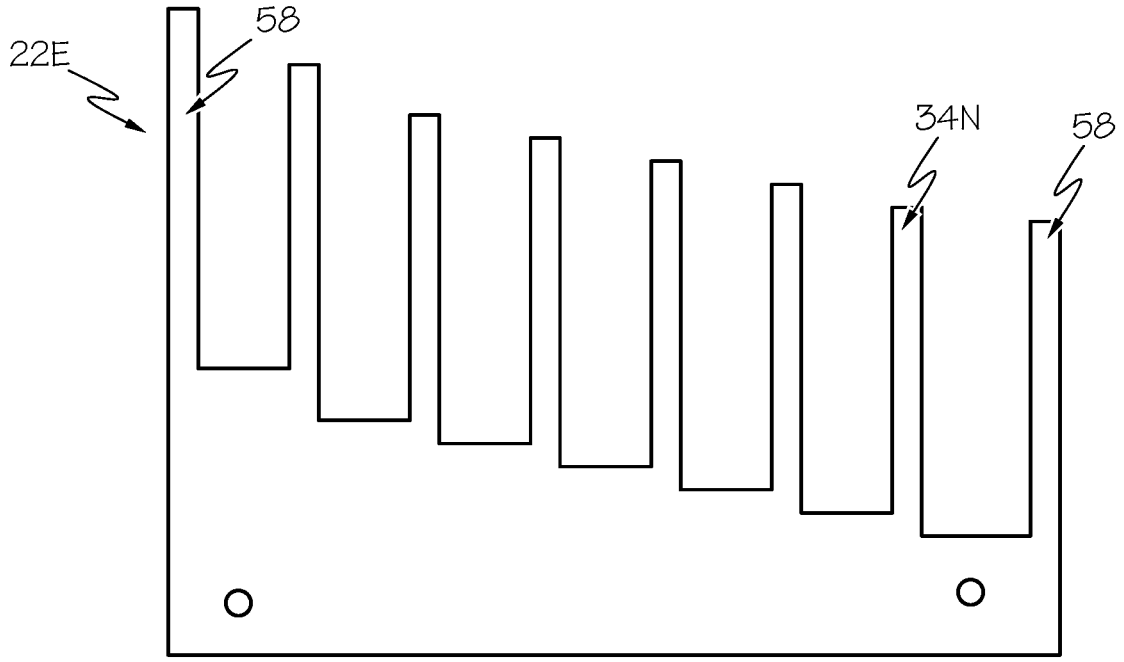

A fifth variation 22E of second member 22 is shown in FIG. 4E. In this variation, the second member has a front protrusion 58 and back protrusion 58 having the same proportions as a medial protrusion 34N.

Figure 4F:
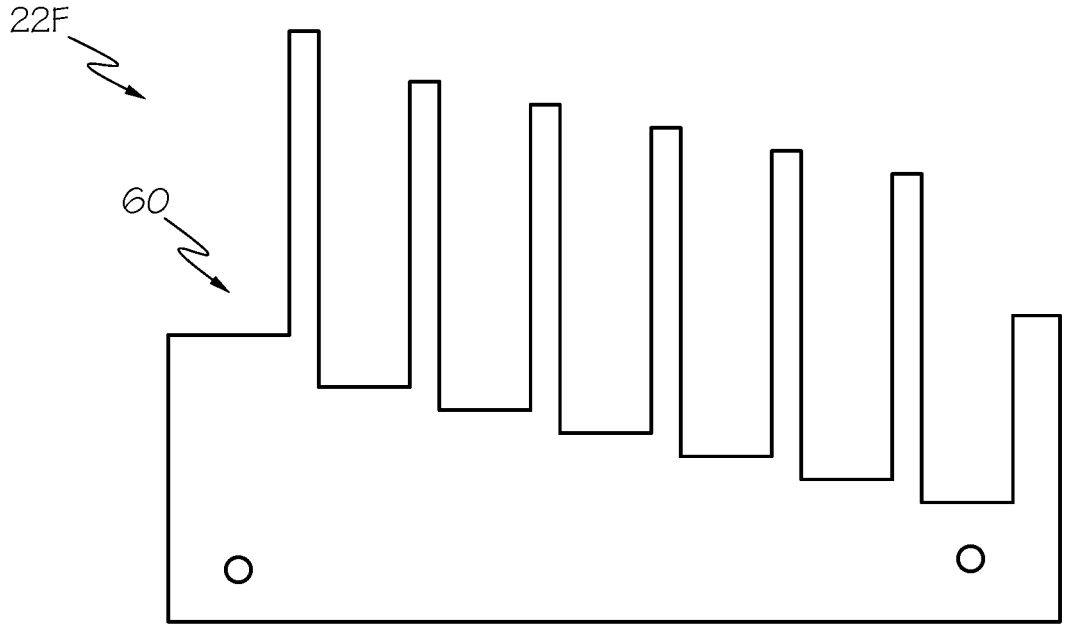

A sixth variation 22F of second member 22 is shown in FIG. 4F. In this variation, the second member has an area open 60 from which back protrusion 40 has been removed. Alternatively or additionally, front protrusion 42 can be removed from second member 22.

Referring now to FIGS. 5A-5C, expandable modular racks 10 having second members 22 of various thicknesses are shown. It should be understood that multiple second members 22 can be place successively next to one another to form magazine bays of a desired width. Furthermore, in some embodiments, such as expandable modular rack 10A shown in FIG. 5A, second member 62 (a type of second member 22) can be of a thickness sufficiently wide (e.g., about 37.5 mm) to accommodate magazine 2 without the need for successive members to build row of magazine bays 26 to a desired width. In such an embodiment, second member 62 can be about 25 to 50 mm wide (lateral thickness).

In still other embodiments, second member 22 can be about 1 to 25 mm in width (lateral thickness). For example, as shown in FIG. 5B, expandable modular rack 10B has a pair of second members 64 about 18.75 mm in width. In another example, as shown in FIG. 5C, expandable modular rack 10C has a trio of second members 66 about 12.5 mm in width. Accordingly, although these examples show one or more second members having a cumulative width of about 37.5 mm, any number of second members of any width can be matched side-by-side to form magazine bays 26 of any desired width.

Referring now to FIG. 6, it is also to be understood that, although expandable modular rack 10 has generally been shown herein containing one row of magazine bays 26 and five handgun bays 28, an expandable modular rack 10 can have as many rows of magazine bays 26 and as many handgun bays 28 as desired. For example, as shown in FIG. 6, expandable modular rack 10D has two row of magazine bays 26. As is also seen, one or more handgun bays 28 can be between magazine bays 26. Furthermore, expandable modular rack 10 can have as many total magazine bays 26 and handgun bays 28 as desired, not merely the six total generally shown in the Figures.

Referring now to FIG. 7, an exploded diagrammatic perspective view is shown of a handgun bay 28 formed by a pair of first members 20 and at least one third member 24 according to an embodiment of the present invention. In some embodiments, handgun bay 28 can also include an optional pair of fourth members 70 for added support.

According to some embodiments, each handgun bay 28 is defined by a vertical portion 72 and a horizontal portion 74. The vertical portion 72 of each handgun bay 28 is for supporting the barrel 14 of an associated handgun 12 or an associated similarly configured item, the horizontal portion 74 of each handgun bay 28 is for supporting the heel 18 of the grip 16 of the associated handgun 12 or the associated similarly configured item, and each handgun bay 28 is of varying width, thereby allowing each handgun bay 28 to store an associated handgun 12 of any width or an associated similarly configured item in its normal upright position or inverted position.

Each pair of first members 20 form a pair of partitions 76. Each pair of partitions 76 define an associated handgun bay 28, with one partition 76 being common for each adjacent of handgun bay 28 or row of magazine bays 26.

Each partition 76 has a vertical portion 78 and a horizontal portion 80. The vertical portion 78 of each partition 76 forms a part of the vertical portion 72 of an associated handgun bay 28. The horizontal portion 80 of each partition 76 partitions adjacent handgun bays 28 or row of magazine bays 26 from each other for separating adjacent handguns 12, magazines 2, and/or adjacent similarly configured items from each other.

Each of the pair of optional fourth members 70 is generally L-shaped and has a vertical portion 82 and a horizontal portion 84. The vertical portion 82 of each of the pair of fourth members 70 form a part of the vertical portion 72 of an associated handgun bay 28 and are for straddling the barrel 14 of an associated handgun 12 or an associated similarly configured item. The horizontal portion 84 of each of the pair of fourth members 70 form a part of the horizontal portion 74 of the associated handgun bay 28, terminate in stops 86, and are for supporting the heel 18 of the grip 16 of the associated handgun 12 or the associated similarly configured item.

The stops 86 of the horizontal portion 84 of each of the pair of fourth members 70 are for preventing the heel 18 of the grip 16 of an associated handgun 12 or an associated similarly configured item from moving back off the horizontal portion 84 of an associated pair of fourth members 70.

The at least one third member 24 is generally L-shaped, is intimately straddled by the pair of fourth members 70, and has a vertical portion 88 and a horizontal portion 90. The vertical portion 80 of the at least one third member 24 forms a part of the vertical portion 72 of an associated handgun bay 28, is intimately straddled by the vertical portions 82 of an adjacent pair of fourth members 70, and is for supporting the barrel 14 of an associated handgun 12 or an associated similarly configured item. The horizontal portion 90 of the at least one third member 24 forms a part of the horizontal portion 74 of the associated handgun bay 28, terminates in a stop 92, is intimately straddled by the horizontal portions 84 of an adjacent pair of fourth members 70, and is for supporting the heel 18 of the grip 16 of the associated handgun 12 or the associated similarly configured item.

The stop 92 of the horizontal portion 90 of the at least one third member 24 is for preventing the heel 18 of the grip 16 of an associated handgun 12 or an associated similarly configured item from moving back off the horizontal portion 90 of an associated third member 24.

The vertical portion 88 of the at least one third member 24 is lower than the vertical portions 82 of a straddling pair of fourth members 70 so as to form a relief 94 therebetween. The relief 94 in the vertical portion 72 of each handgun bay 28 is for receiving the barrel 14 of an associated handgun 12 or an associated similarly configured item.

According to some embodiments, the at least one third member 24 can be more than one for a handgun bay 28 having a handgun 12 with a wider than normal barrel 14.

It will be understood that each of the elements described above or two or more together may also find a useful application in other types of constructions differing from the types described above.

Referring now to FIG. 8A, an exploded diagrammatic perspective view is shown of an alternative embodiment of a row of magazine bays formed by a pair of first members 20, at least one third member 24, and a fourth member 122 according to an embodiment of the present invention. Additional views of fourth member 122 are also shown in FIG. 8B, which shows an example embodiment of the fourth member 122 within the scope of the present invention, and FIG. 8C, which shows a side view of fourth member 122 according to an embodiment of the present invention fitted next to a first member 20.

In some embodiments, one or more handgun bays 28 can be modified with one or more fourth member(s) 122 to form a row of magazine bays 126. As shown in FIG. 8A, fourth member 122 is inserted on top of horizontal portion 90 of third member 24, against vertical portion 88 of third member 24, and between inner side walls 44 of a pair of first members 20. This modifies handgun bays 28 so that it can be used to store one or more magazines 2. According to some embodiments of the present invention, fourth member 122 includes at least a base portion 132 and at least one upright protrusion 134A extending from a medial or middle portion of base 132.

Some members 122 can have a plurality of upright protrusions 134A-N. The distance between successive upright protrusions 134A-N along a longitudinal axis of fourth member 122 is generally suitable for encompassing the width of a typical magazine 2. In some embodiments, this distance is about 10 to 30 mm. Each upright protrusion 134A-N can have a width along the longitudinal axis of fourth member 122 which, based on a strength and/or rigidity of the material from which expandable modular rack 10 is made, is suitable for supporting a typical magazine 2 in an upright or inverted position. In some embodiments, the width of an upright protrusion 134A-N along the longitudinal axis of fourth member 122 is about 1 to 20 mm.

According to some embodiments, distal ends of base 132 may also have back protrusion 140, which lays against vertical portion 88 of third member 24, and front protrusion 142, although such features need not appear in all embodiments of the present invention. Back protrusion 140 may be of a same, greater, or lessor height as the tallest portion of first member 20. Front protrusion 142 may have a height equal to or lower than the shortest protrusion of upright protrusions 34A-N and a thickness at least as thick as that of an upright protrusion 134A-N.

Between upright protrusions 134A-N, along a top of base portion 132 of fourth member 122, are a plurality of magazine base supporting areas 136A-N. Base 4 of a magazine 2 may rest upon this area, while body 6 of the magazine 2 is supported in an upright position by inner side walls 44 of a pair of first members 20 and by a pair of upright protrusions 134A-N (or, in the case of the first or last supporting area 136A or 136N, by one upright protrusion 134A or N and back protrusion 140 or front protrusion 142, respectively). The inner side walls 44 of a pair of first members 20 and each pair of upright protrusions 134A-N form magazine bays 138A-N. As mentioned above the longitudinal distance between upright protrusions 134A-N is about 10 to 30 mm, making each magazine bay 138A-N about 10 to 30 mm wide along the longitudinal axis of fourth member 122. A magazine 2 may be deposited into each magazine bay 138A-N when expandable modular rack 10 is in use.

It is understood that fourth member 122 can be modified in any manners shown herein with respect to second member 22, as well as other manners which will occur to those trained in the art. Such modifications include, but are not limited to: upright protrusions 134A-N and/or supporting areas 136A-N of different, tiered heights (See FIG. 4A); upright protrusions 134A-N and/or supporting areas 136A-N of same heights (See FIG. 4B); upright protrusions 134A-N only a little shorter than typical magazines 2 (See FIG. 4A); upright protrusions 134A-N significantly shorter than typical magazines 2 (See FIG. 4C); upright protrusions 134A-N forming a non-right angle with supporting areas 136A-N(See FIG. 4D); back protrusion 140 or front protrusion 142 of a same longitudinal width as upright protrusions 134A-N(See FIG. 4E); back protrusion 140 or front protrusion 142 non-existent (See FIG. 4F); upright protrusions 134A-N non-existent, the fourth member having only tiered supporting areas 136A-N; and/or upright protrusions 134A-N and/or supporting areas 136A-N having differing longitudinal widths from their fellows. Furthermore, fourth member 122 can be modified using any combination of the various modifications shown herein with respect to second member 22. All such modifications are to be considered within the scope of the present invention.

Furthermore, it is also to be understood that fourth member 122 can be of various lateral thicknesses, similar to second member 22 as shown in FIGS. 5A-C. Furthermore, as many fourth member 122 as needed or desired can be stacked together to form a row of magazine bays 126 on top of a handgun bay 28 that collectively have the same width as that handgun bay 28. As such, in some embodiments, fourth member 122 can be about 1 to 50 mm wide (lateral thickness). Moreover, there is no limit to the number of handgun bays 28 that can each be modified with at least one fourth member 122 to form rows of magazine bays 126.

According to some embodiments, fourth member 122 can be held in place by friction on top of horizontal portion 90 of third member 24, against vertical portion 88 of third member 24, and/or between inner side walls 44 of a pair of first members 20. Additionally or in the alternative, fourth member 122 can have an attachment notch 128 on an underside of base portion 132 near or at an end of base portion 132. This attachment notch 128 can receive stop, lip or edge 92 of horizontal portion 90 of third member 24. In some embodiments, base portion 132 can extend longitudinally beyond stop/edge 92 of horizontal portion 90 of third member 24, as shown in FIG. 8C. In still other embodiments, base portion 132 can be even with stop/edge 92 of horizontal portion 90 of third member 24. In still other embodiments, base portion 132 can be longitudinally shorter than stop/edge 92 of horizontal portion 90 of third member 24, allowing stop/edge 92 to hold fourth member 122 in place.

Additionally or in the alternative, fourth member 122 be attached to horizontal portion 90 of third member 24, vertical portion 88 of third member 24, and/or inner side walls 44 of a pair of first members 20 by any member joiner means now known or later developed. Such member joiner means can include, but is not limited to hook and loop fabric, dual lock tape, ultrasonic bonding, a set of snaps, an adhesive substance, a synthetic *setae* material, a screw, a bolt, a nail, and a dowel, similar to those discussed in more detail above. For example, a snap could be placed on a back of back protrusion 140 of fourth member 122 and a complimentary snap could be placed on a front of vertical portion 88 of third member 24, allowing fourth member 122 to be joined to third member 24 by joining the complimentary snaps. As will be apparent to those trained in the art, hook and loop fabric, dual lock tape, ultrasonic bonding, an adhesive substance, and a synthetic setae material could all be used in a similar manner. In another example, a nail could be driven thorough base portion 132 of fourth member 122 to and through at least part of horizontal portion 90 of third member 24, thereby attaching the two members to one another. As will be apparent to those trained in the art, a screw, a bolt, and a dowel, could all be used in a similar manner.

While the invention has been illustrated and described as embodied in an expandable modular rack for storing at least one magazine and at least one handgun of any width and/or at least similarly configured items in their normal upright position or inverted position, however, the present invention is not limited to the details shown, since it will be understood that various omissions, modifications, substitutions, and changes in the forms and details of the device illustrated and its operation can be made by those skilled in the art without departing in any way from the spirit of the present invention.

Without further analysis, the foregoing will so fully reveal the essence of the present invention that others can by applying current knowledge readily adapt it for various applications without omitting features that from the standpoint of prior art fairly constitute characteristics of the generic or specific aspects of the invention.

What is claimed is:

1. A rack for storing a first item in an upright position, the rack comprising:
   - at least one first member;
   - at least one second member having a base and at least one protrusion extending from a medial portion of the base;
   - a means for joining a surface of the at least one first member to a surface of the at least one second member;
   - at least one third member having a base and an upright protrusion extending from an end of said base; and
   - a means for joining the at least one first member to the at least one third member,
   - wherein the at least one first member is arranged to maintain the first item in the upright position,
   - wherein the base of the second member is arranged to support a base of the first item and the at least one protrusion of the second member is arrangeable to maintain the first item in the upright position, and
   - wherein the base of one of the at least one second members is situated on top of the base of one of the at least one third members.

2. The rack of claim 1, wherein a distal lateral face of the at least one second member is substantially flush with a distal lateral face of the at least one first member.

3. The rack of claim 1, the means for joining the at least one first member to the at least one third member further being a means for joining a surface of the at least one first member to a surface of the at least one third member.

4. The rack of claim 3, the surface at which the at least one first member is joined to the at least one third member being a surface arranged to maintain the second item in the upright position, and the surface at which the at least one first member is joined to the at least one second member being a surface arranged to maintain the first item in the upright position, wherein the surface arranged to maintain the second item in the upright position and the surface arranged to maintain the first item in the upright position are on opposite sides of the first member.

5. The rack of claim 1, wherein a pair of first members form a pair of partitions.

6. The rack of claim 5, wherein at least one partition formed by the pair of partitions has at least one of the second members and wherein at least one other partition formed by the pair of partitions has at least one of the third members.

7. The rack of claim 1, wherein a position of the first member, a position of the second member, and a position of the third member are interchangeable with respect to one another.

8. The rack of claim 1, the first member and the second member having a same longitudinal length.

9. The rack of claim 1, the first member and the second member having a same lateral thickness.

10. The rack of claim 1, the base on one side of the protrusion having a different height than the base on the other side of the protrusion.

11. The rack of claim 1, the protrusion forming an angle between 30 and 90 degrees with the base.

12. The rack of claim 1, the means for joining the surface of the at least one first member to the surface of the at least one second member being a fastener selected from the group consisting of: an elongated member and end securing devices, a threadable material, hook and loop fabric, dual lock tape, ultrasonic bonding, a set of snaps, an adhesive substance, a synthetic *setae* material, a screw, a bolt, a nail, and a dowel.

13. The rack of claim 1, the rack comprising at least two first members and a plurality of second members.

14. The rack of claim 1, the second member having a lateral thickness between one and fifty mm.

15. The rack of claim 1, the at least one protrusion of the second member having a longitudinal thickness between one and twenty mm.

16. The rack of claim 1, wherein the first member and the second member are made from a same type of material.

17. A rack for storing a first item in an upright position and a second item in an upright position, the second item having a base portion and a laterally projecting portion, the rack comprising:

at least one first member;

at least one second member having a base and at least one protrusion extending from a medial portion of the base;

a means for joining a surface of the at least one first member to a surface of the at least one second member;

at least one third member having a base and an upright protrusion extending from an end of said base; and a means for joining the at least one first member to the at least one third member, wherein the base of the at least one third member is arranged to support the base portion of the second item and the upright protrusion of the one third member is arranged to support the laterally projecting portion of the second item, wherein the at least one first member is arranged to maintain the second item in the upright position and to maintain the first item in the upright position, wherein the base of the second member is arranged to support a base of the first item and the at least one protrusion of the second member is arrangeable to maintain the first item in the upright position, and wherein the base of one of the at least one second members is situated on top of the base of one of the at least one third members.

* * * * *